US006104366A

United States Patent [19]

Matsuda

[11] Patent Number: 6,104,366

[45] Date of Patent: Aug. 15, 2000

[54] DRIVING DEVICE FOR LIQUID CRYSTAL DISPLAY WITH A HIGH YIELD

[75] Inventor: Kohei Matsuda, Shiga, Japan

[73] Assignee: NEC Corporation, Tokyo, Japan

[21] Appl. No.: 08/939,501

[22] Filed: Sep. 29, 1997

[30] Foreign Application Priority Data

Dec. 27, 1996 [JP] Japan ..... 8-256260

[51] Int. Cl.[7] ..... G09G 3/36

[52] U.S. Cl. ..... 345/93; 345/89; 345/204

[58] Field of Search ..... 345/93, 98, 100, 345/204, 89

[56] References Cited

U.S. PATENT DOCUMENTS 5,859,627 1/1999 Hoshiya et al. ..... 345/93

*Primary Examiner*—Regina Liang

*Attorney, Agent, or Firm*—Sughrue, Mion, Zinn, Macpeak & Seas, PLLC

[57] ABSTRACT

A driving device is for driving a liquid crystal display in accordance with a display data signal. A shift register circuit produces first through N-th control signals from first through N-th shift output terminals, respectively, in synchronism with the clock signal, where N represents a positive integer greater than one. First through N-th output circuit produces first through N-th gradation voltages in correspondence with the display data signal in synchronism with the first through the N-th control signals, respectively. An additional output circuit produces an additional gradation voltage in correspondence with the display data signal in synchronism with an additional control signal. A connecting circuit connects the additional output circuit to an n-th shift output terminal instead of an n-th output circuit when the n-th output circuit becomes faulty, where n is a variable between one and N, both of inclusive. The connecting circuit supplies the additional output circuit with an n-th control signal as the additional control signal to make the additional gradation voltage as an n-th gradation voltage.

8 Claims, 5 Drawing Sheets

DRIVING DEVICE FOR LIQUID CRYSTAL DISPLAY WITH A HIGH YIELD

BACKGROUND OF THE INVENTION

This invention relates to a driving device for driving a liquid crystal display, more particularly, to a driving device for a liquid crystal display with a high yield on manufacturing.

In general, a driving device for a liquid crystal display is composed of semiconductor integrated circuits which are connected to one another in cascade. It is known in the art that a conventional driving device produces a plurality of output signals each of which is for use in driving the liquid crystal display. The output signals may have output voltages different from one another. Each of the output voltages may be called a gradation voltage.

However, yield reduces as will be described later when the conventional driving device is manufactured by the semiconductor integrated circuits.

SUMMARY OF THE INVENTION

It is therefore an object of this invention to provide a driving device for a liquid crystal display that is capable of being manufactured with a high yield.

Other objects of this invention will become clear as the description proceeds.

On describing the gist of this invention, it is possible to understand that a driving device is for driving a liquid crystal display in accordance with a display data signal.

According to this invention, the driving device comprises (A) shift register means having a register input terminal, a register output terminal, and first through N-th shift output terminals, where N represents a positive integer which is greater than one, the shift register means being supplied with a start signal at the register input terminal for shifting the start signal in accordance with a clock signal to produce, from the register output terminal, a shifted start signal representative of a start of display, the shift register means producing first through N-th control signals from the first through the N-th shift output terminals, respectively, in synchronism with the clock signal, (B) first through N-th output means connected to the first through the N-th shift output terminals, respectively, for producing first through N-th gradation voltages in correspondence with the display data signal in synchronism with the first through said N-th control signals, respectively, (C) additional output means for producing an additional gradation voltage in correspondence with the display data signal in synchronism with an additional control signal, and (D) connecting means for connecting the additional output means to an n-th shift output terminal instead of an n-th output means when the n-th output means becomes faulty, where n is a variable between one and N, both inclusive, the connecting means supplying the additional output means with an n-th control signal as the additional control signal to make the additional gradation voltage as an n-th gradation voltage.

DESCRIPTION OF THE PREFERRED EMBODIMENT

Figure 1:
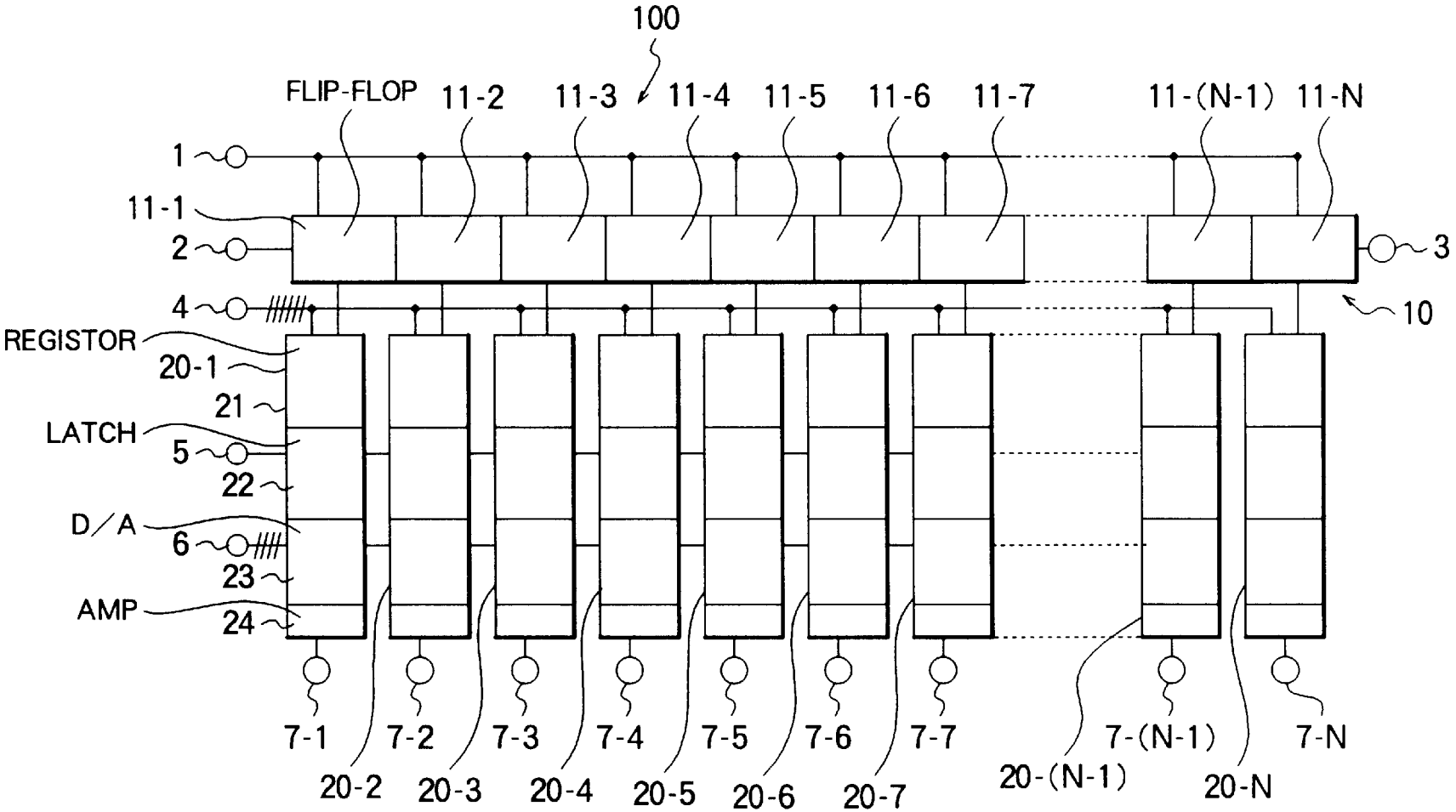
FIG. 1 PRIOR ART
FIG. 1 is a block diagram of a conventional driving device for a liquid crystal display.

Referring to FIG. 1, a conventional driving device for a liquid crystal display will be described at first in order to facilitate an understanding of this invention. The illustrated driving device 100 comprises a shift register 10 which has first through N-th flip-flops 11-1 to 11-N connected to one another in cascade, where N represents a positive integer which is greater one. The first through the N-th flip-flops 11-1 to 11-N are connected to first through N-th output sections 20-1 to 20-N which are similar in structure to one another. More particularly, each of the first through the N-th output sections 20-1 to 20-N comprises a data register 21, a latch circuit 22, a digital-analog (D/A) converter 23, and an amplifier circuit 24.

Each of the first through the N-th flip-flops 11-1 to 11-N is connected to an clock input terminal 1 to which a clock signal is supplied. The first flip flop 11-1 is connected to a register input terminal 2 to which a start signal is supplied. The N-th flip-flop 11-N is connected to a register output terminal 3.

As described above, each of the first through the N-th output sections 20-1 to 20-N comprises the data register 21, the latch circuit 22, the digital-analog (D/A) converter 23, and the amplifier circuit 24. The data register 21 is connected to an n-th flip-flop 11-n and a display signal input terminal 4 in an n-th output section 20-n, where n is a variable between one and N, both inclusive. The latch circuit 22 is connected to the the data register 21 and a latch signal input terminal 5. The D/A converter 23 is connected to the latch circuit 22 and a gradation voltage input terminal 6. The amplifier circuit 24 is connected to the D/A converter 23 and an n-th output terminal 7-n.

The display signal input terminal 4 is supplied with a display data signal. The first through the N-th flip-flops 11-1 to 11-N is supplied with the clock signal from the clock input terminal 1 in synchronism with the display data signal. Furthermore, the start signal is supplied to first flip-flop 11-1 from the register input terminal 2. The start signal is shifted from the first flip-flop 11-1 to the N-th flip-flop 11-N in synchronism with clock signal. The first through N-th flip-flops 11-1 to 11-N supply the first through the N-th output sections 20-1 to 20-N with first through N-th control signals to each of which is for use in taking the display data signal in the data register 21. In other words, the shift register 10 has first through N-th shift output terminals. The shift register 10 produces the first through the N-th control signals from the first through N-th shift output terminals, respectively. The N-th flip-flop 11-N produces a shift start signal which is supplied to a driving unit (not shown) connected to the register output terminal 3 in cascade.

In the n-th output section 20-n, the display data signal is taken in the data register 21 as an n-th registered signal in synchronism with the n-th control signal. Namely, the first through N-th output sections 20-1 to 20-N take in display data signal in synchronism with the first through the N-th control signals, respectively.

In the n-th output section 20-n, the n-th registered signal is latched as an n-th latched data signal in the latch circuit 22 in synchronism with the latch signal supplied to the latch input terminal 5. The n-th latched data signal is supplied to the D/A converter 23. The D/A converter 23 produces an n-th gradation voltage in accordance with the n-th latched data signal. The n-th gradation voltage is amplified into an n-th amplified voltage. As readily understood from the above description, the first through the N-th output sections 20-1 to 20-N produce first through N-th amplified voltages which are outputted from the first through N-th gradation output terminals 7-1 to 7-N, respectively. The first through the N-th amplified voltages may be different from one another. In addition, the first through the N-th amplified voltages may be equal to one another.

By the way, chip yield decreases when the driving device is manufactured by the semiconductor integrated circuit, as the positive integer N becomes great and the degree of gradation becomes great. More particularly, the chip yield becomes 85 percents in test when the driving device has 310 outputs and 64 gradations. It is difficult to obtain a high yield in the driving device illustrated in FIG. 1. More particularly, faulty almost occurs in either one of the D/A converters when the driving device is manufactured by a semiconductor chip.

Figure 2:
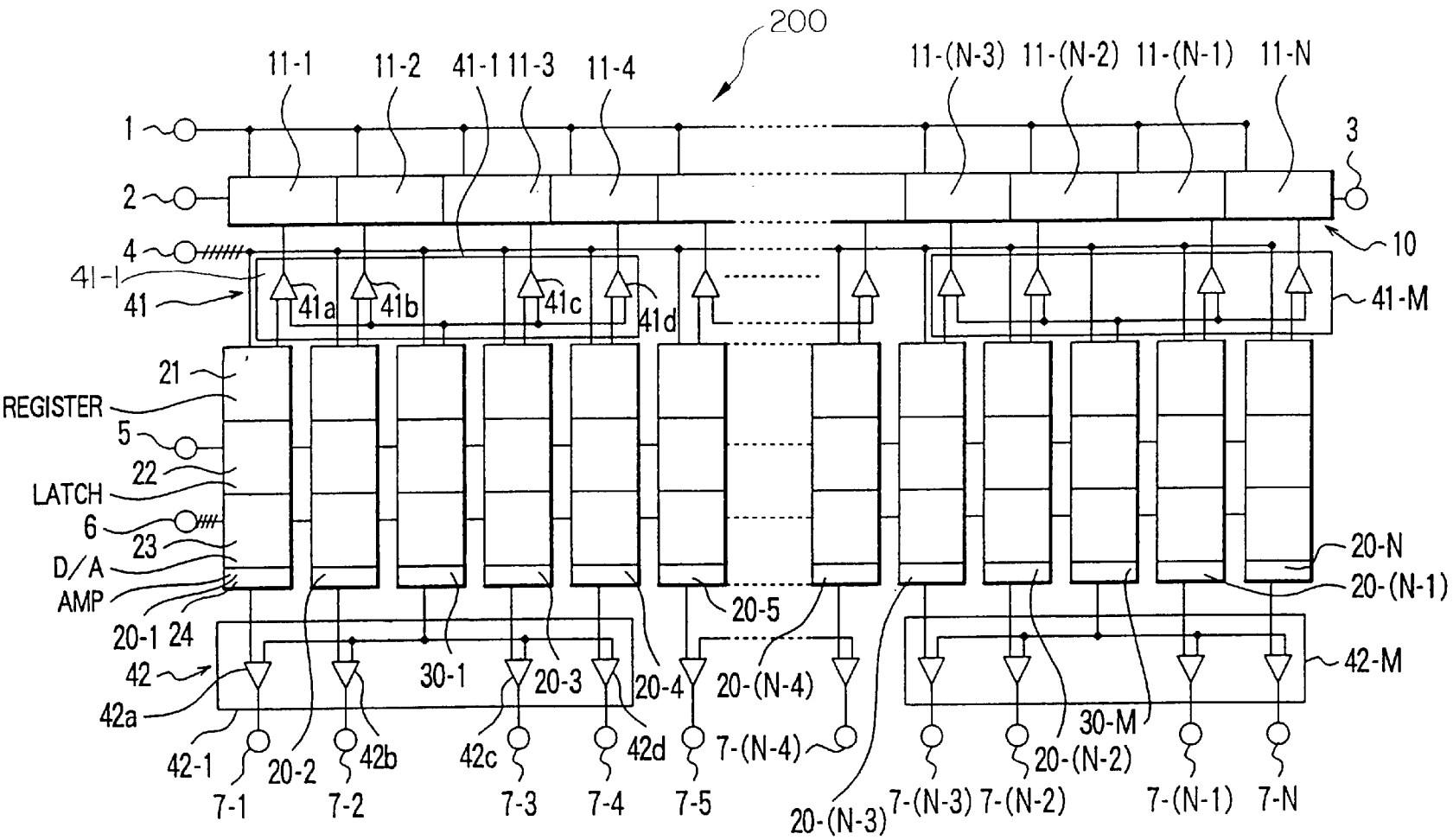
FIG. 2 is a block diagram of a driving device for a liquid crystal display according to a preferred embodiment of this invention.

Referring to FIG. 2, description will proceed to a driving device for the liquid crystal display according to a preferred embodiment of this invention. The illustrated driving device is different in structure from the driving device 100 illustrated in FIG. 1 and is therefore designated afresh by a reference numeral 200. The driving device 200 comprises similar parts which are designated by like reference numerals and operable with likewise named signals.

The driving device 200 further comprises first through M-th additional output sections 30-1 to 30-M and first and second switching sections 41 and 42, where M represents a positive integer which is less than the positive integer N. Each of first through M-th additional output sections 30-1 to 30-M is similar in function to each of the first through the N-th output sections 20-1 to 20-N.

The first through the N-th output sections 20-1 to 20-N is grouped into first through M-th groups. Each of the first through the M-th groups includes output sections of a predetermined number in an ascending order and includes either one of first through M-th additional output sections 30-1 to 30-M. In the example being illustrated, the predetermined number is equal to four. The first group includes the first through the fourth output sections 20-1 to 20-4 and the first additional output section 30-1. The M-th group includes (N−3)-th through N-th output sections 20-(N−3) to 20-N and the M additional output section 30-M. In each of the first through M-th groups, the additional output section is located between the output sections as illustrated in FIG. 2.

The first switching section 41 comprises first through M-th primary switching units 41-1 to 41-M each of which has first through fourth primary switches 41*a* to 41*d*. The second switching section 42 comprises first through M-th subsidiary switching units 42-1 to 42-M each of which has first through fourth subsidiary switches 42*a* to 42*d*.

Attention will be directed to the first primary switching unit 41-1. Each of the first through fourth primary switches 41*a* to 41*d* has a primary output terminal and first and second primary output terminals. The first through fourth primary switches 41*a* to 41*d* are connected to first through fourth flip-flops 11-1 to 11-4 at the primary input terminal, respectively. The first through fourth primary switches 41*a* to 41*d* are connected to first through fourth output sections 20-1 to 20-4 at the first primary output terminal, respectively. Each of the first through fourth primary switches 41*a* to 41*d* is connected to the first additional output section 30-1 at the second primary output terminals.

Each of the first through fourth subsidiary switches 42*a* to 42*d* has first and second subsidiary input terminals and a subsidiary output terminal. The first through fourth subsidiary switches 42*a* to 42*d* are connected to first through fourth output sections 20-1 to 20-4 at the first subsidiary input terminal, respectively. Each of the first through fourth subsidiary switches 42*a* to 42*d* is connected to first additional output section 30-1 at the second subsidiary input terminal. The first through fourth subsidiary switches 42*a* to 42*d* are connected to the first through fourth output terminals 7-1 to 7-4 at the subsidiary output terminal, respectively.

As readily understood from the above description, the first through the fourth primary switches 41*a* to 41*d* are connected to the (N−3)-th through the N-th flip-flops 11-(N−3) to 11-N, respectively, in the M-th primary switching unit 41-M. The first through the fourth primary switches 41*a* to 41*d* are connected to the (N−3)-th through the N-th output sections 20-(N−3) to 20-N, respectively, in the M-th primary switching unit 41-M. Each of the first through the fourth primary switches 41*a* to 41*d* is connected to the M-th additional output section 30-M in the M-th primary switching unit 41-M. The first through fourth subsidiary switches 42*a* to 42*d* are connected to (N−3)-th through N-th output sections 20-(N−3) to 20-N, respectively, in the M-th subsidiary switching unit 42-M. Each of the first through fourth subsidiary switches 42*a* to 42*d* is connected to M-th additional output section 30-M in the M-th subsidiary switching unit 42-M. The first through fourth subsidiary switches 42*a* to 42*d* are connected to the (N−3)-th through N-th output terminals 7-(N−3) to 7-N, respectively, in the M-th subsidiary switching unit 42-M.

Figure 3:
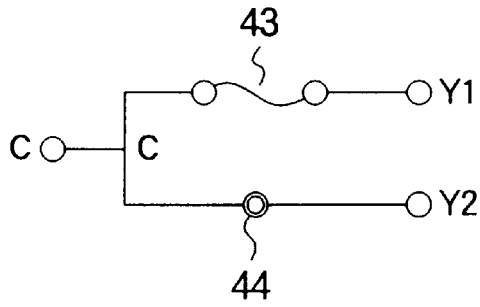
FIG. 3 shows a view for describing a switch illustrated in FIG. 2.

Referring to FIG. 3, the first through the fourth primary switch 41*a* to 41*d* are similar in structure to one another. Attention will be directed to the first primary switch 41*a*. The first primary switch 41*a* comprises first and second trimming portions 43 and 44. The first trimming portion 43 is located between the primary input terminal C and the first primary output terminal Y1. The second trimming portion 44 is located between the primary input terminal C and the second primary output terminal Y2. When an energy beam is irradiated to the first primary switch 41*a*, the first trimming portion 43 disconnects the primary input terminal C to the first primary output terminal Y1. Otherwise, the second trimming portion 44 connects the primary input terminal C to the second primary output terminal Y2.

Figure 4:
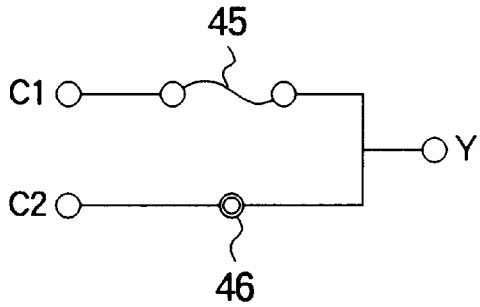
FIG. 4 shows a view for describing a switch illustrated in FIG. 2.

Referring to FIG. 4, the first through the fourth subsidiary switches 42*a* to 42*d* are similar in structure to one another. Attention will be directed to the first subsidiary switch 42*a*. The first subsidiary switches 42*a* comprises third and fourth trimming portions 45 and 46. The third trimming portion 45 is located between the first subsidiary input terminal C1 and the subsidiary output terminal Y. The fourth trimming portion 46 is located between the second subsidiary input terminal C2 and the subsidiary output terminal Y. When the energy beam is irradiated to the first subsidiary switch 42*a*, the third trimming portion 45 disconnects the first subsidiary input terminal C1 to the subsidiary output terminal Y.

Otherwise, the fourth trimming portion 46 connects the second subsidiary input terminal C2 to the subsidiary output terminal Y.

Figure 5:
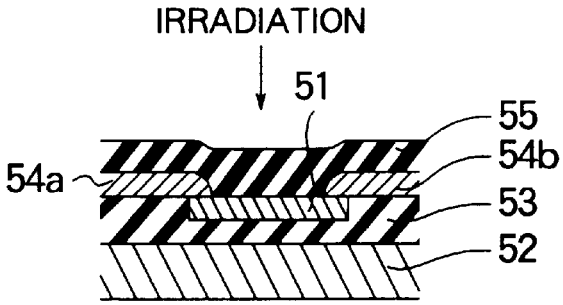
FIG. 5 shows a plan view for illustrating an example of first and third trimming portions.

Referring to FIG. 5, each of the first and the third trimming portions 43 and 45 is formed on the semiconductor integrated circuit. The first trimming portion 43 is similar in structure to the third trimming portion 45. In FIG. 5, a polysilicon layer 51 is used as a trimming portion. In the example being illustrated, a first insulating layer 53 is formed on a semiconductor substrate 52. The polysilicon layer 51 is formed on the first insulating layer 53. First and second alminum wirings 54*a* and 54*b* are formed on the first insulating layer 53 and are connected to the polysilicon layer 51. The first and second alminum wirings 54*a* and 54*b* may be connected to the switch input and output terminals, respectively. A second insulating layer 55 is formed on the polysilicon layer 51 and the first and the second alminum wirings 54*a* and 54*b*. When the laser beam is irradiated to the polysilicon layer 51 through the second insulating layer 55, the polysilicon layer 55 becomes a non-continuity state.

Figure 6:
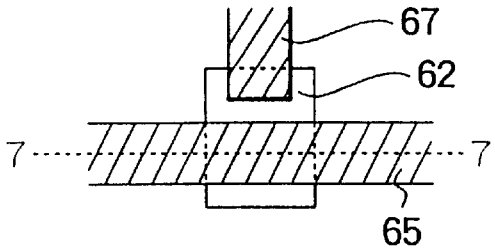
FIG. 6 shows a plan view for illustrating a first example of second and fourth trimming portions.
Figure 7:
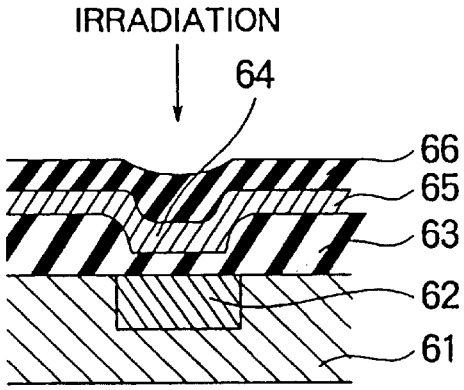
FIG. 7 shows a sectional view along an A–A' line in FIG. 6.

Referring to FIGS. 6 and 7, each of the second and the fourth trimming portions 44 and 46 is formed on the semiconductor integrated circuit. The second trimming portion 44 is similar in structure to the fourth trimming portion 46. A diffusion layer 62 of $N^+$ type is formed as a first conductive layer on a semiconductor substrate 61 of P type. After a first insulating layer 63 is formed on the diffusion layer 62, a gate oxide layer 64 is formed at a position of a trimming portion on the diffusion layer 62 instead of the first insulating layer 63. An alminum layer 65 is formed as a second conductive layer on the gate oxide layer 64. A second insulating layer 66 is formed on the alminum layer 65. The diffusion layer 62 is electrically connected to an alminum wiring 67. When the laser beam is irradiated to the gate oxide layer 64 through the second insulating layer 66, the gate oxide layer 64 fuses to make the diffusion layer 62 weld the alminum layer 65. As a result, the diffusion layer 62 is electrically connected to the alminum layer 65.

Figure 8:
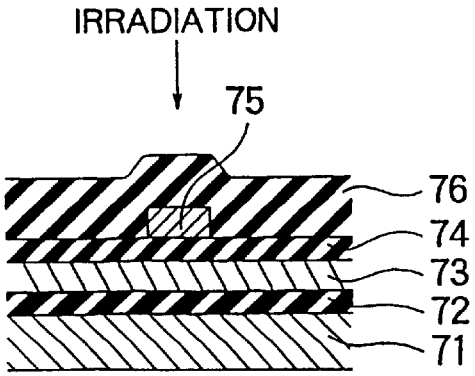
FIG. 8 shows a plan view for illustrating a second example of the second and the fourth trimming portions.

Referring to FIG. 8, another example will be described in connection with each of the second and the fourth trimming portions 44 and 46. A first insulating layer 72, a polysilicon layer 73, a second insulating layer 74, an alminum layer 75, and a third insulating layer 76 are formed in this order at a position of a trimming portion on a semiconductor substrate 71. The polysilicon layer 73 is used as the first conductive layer. The alminum layer 75 is used as the second conductive layer. When the laser beam is irradiated on the third insulating layer 76, the second insulating layer 74 fuses to make the alminum layer 75 weld to the polysilicon layer 73. As a result, the polysilicon layer 73 is electrically connected to the alminum layer 75.

Figure 9:
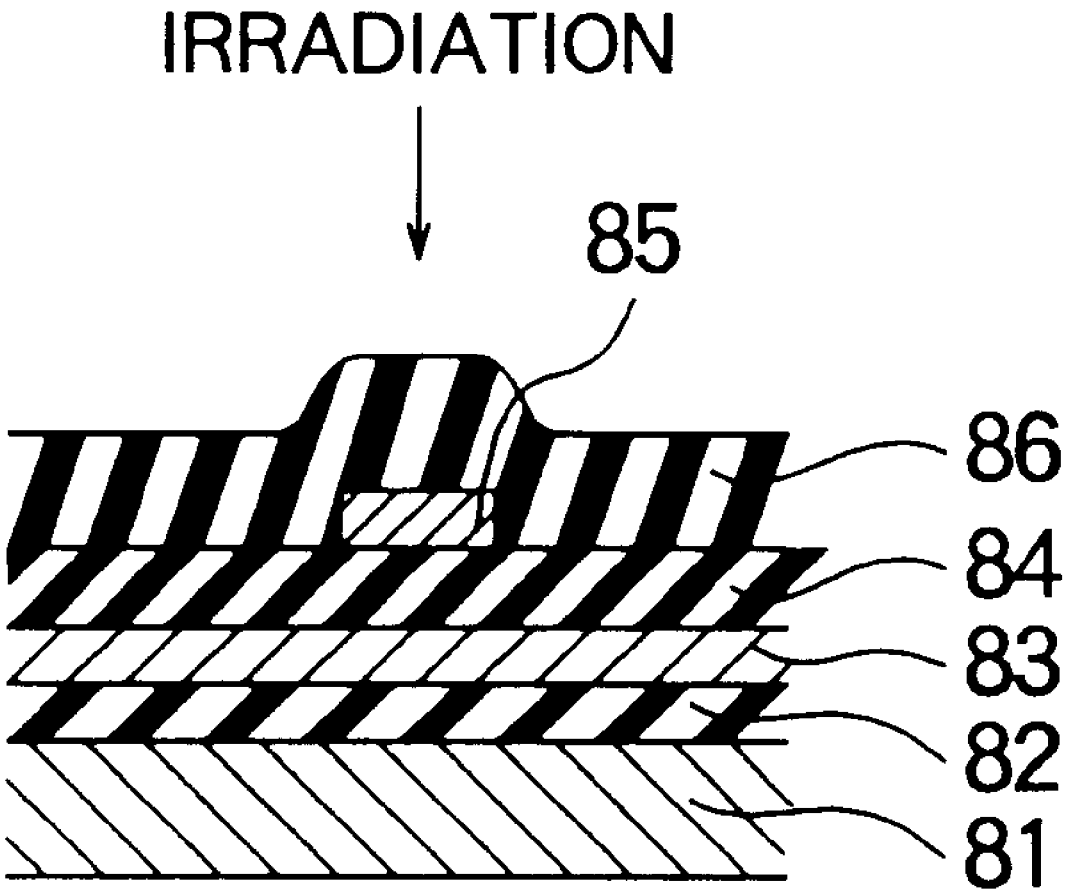
FIG. 9 shows a plan view for illustrating a third example of the second and the fourth trimming portions.

Referring to FIG. 9, still another example will be described in connection with each of the second and the fourth trimming portions 44 and 46. A first insulating layer 82, a first alminum layer 83, a second insulating layer 84, a second alminum layer 85, and a third insulating layer 86 are formed in this order at a position of a trimming portion on a semiconductor substrate 81. The first alminum layer 83 is used as the first conductive layer. The second alminum layer 85 is used as the second conductive layer. When the laser beam is irradiated on the third insulating layer 86, the second insulating layer 84 fuses to make the first alminum layer 83 weld to the second alminum layer 85. As a result, the first alminum layer 83 is electrically connected to the second alminum layer 85.

Again referring to FIG. 2 in addition to FIGS. 3 and 4, it will be assumed that the second output section 20-2 becomes faulty. The laser beam is irradiated to the second primary switch 41*b* in the first primary switching unit 41-1. Furthermore, the laser beam is irradiated to the second subsidiary switch 42*b* in the first subsidiary switching unit 42-1. As a result, each of the first and the third trimming portions 43 and 45 becomes the non-continuity state. Each of the second and the fourth trimming portions 44 and 46 becomes the continuity state. Accordingly, the second primary switch 41*b* of the first primary switching unit 41-1 connects the second flip-flop 11-2 to the first additional output section 30-1 instead of the second output section 20-2. The second subsidiary switch 42*b* of the first subsidiary switching unit 42-1 connects the second output terminal 7-2 to the first additional output section 30-1 instead of the second output section 20-2.

It will be assumed that the driving device has outputs of 384. In other words, it will be assumed that the positive number N is equal to 384. Furthermore, it will be assumed that faulty occurs in any one of the output sections when manufacturing the semiconductor integrated circuit. When yield is equal to 80 percent in conventional driving devices having no additional output section, fraction defective becomes about 17 percent according to simulation if faulty occurs in one of the output sections. Therefore, yield increases 17 percent when the additional output section is used instead of the faulty output section. More particularly, it will be assumed that the positive integer N is equal to 384 and that positive integer M is equal to four. When one of the output sections becomes faulty in each of the groups, the additional output section is used as the faulty output section. Although a chip size becomes large at about 1 percent, yield increases more than 15 percent.

While this invention has thus far been described in conjunction with the preferred embodiment thereof, it will readily be possible for those skilled in the art to put this invention into practice in various other manners.

What is claimed is:

1. A driving device for driving a liquid crystal display in accordance with a display data signal, said driving device comprising:

shift register means having a register input terminal, a register output terminal, and first through N-th shift output terminals, where N represents a positive integer which is not less than ninety six, said shift register means being supplied with a start signal at said register input terminal for shifting said start signal in accordance with a clock signal to produce, from said register output terminal, a shifted start signal representative of a start of display, said shift register means producing first through N-th control signals from said first through said N-th shift output terminals, respectively, in synchronism with said clock signal;

first through N-th output means connected to said first through said N-th shift output terminals, respectively, for producing first through N-th gradation voltages in correspondence with said display data signal in synchronism with said first through said N-th control signals, respectively;

a single additional output means for producing an additional gradation voltage in correspondence with said display data signal in synchronism with an additional control signal; and connecting means for connecting said additional output means for an n-th shift output terminal, wherein when an n-th output means becomes faulty, where n is a variable between one and N, both inclusive, said connecting means supplies said additional output means with an n-th control signal as said additional control signal for producing said additional gradation voltage as an n-th gradation voltage.

2. A driving device as claimed in claim 1, wherein said shift register means comprises first through N-th flip-flops for supplying said first through said N-th shift output terminals with said first through said N-th control signals, respectively, in synchronism with said clock signal when said first flip-flop is supplied with said start signal, said N-th flip-flop suppling said shifted start signal with said register output terminal in synchronism with said clock signal.

3. A driving device as claimed in claim 2, further comprising first through N-th gradation output terminals [which is] for outputting said first through N-th gradation voltages, respectively, wherein said connecting means comprises:

a first connecting section for connecting said additional output means to said n-shift output terminal instead of said n-th output means when said n-th output means becomes faulty; and a second connecting section for connecting said additional output means to an n-th gradation output terminal instead of said n-th output means when said n-th output means becomes faulty.

4. A driving device as claimed in claim 3, said driving device being manufactured by semiconductor integrated circuit, wherein:

said first connecting section comprises first through N-th primary switches each of which has a primary connecting input terminal and first and second primary connecting output terminals, an n-th primary switch being connected to said n-th shift output terminal at said primary connecting input terminal and being connected to said n-th output means and said additional output means at said first and said second primary connecting output terminals, respectively; and said second connecting section comprises first through N-th subsidiary switches each of which has first and second subsidiary connecting input terminals and a subsidiary connecting output terminal, an n-th subsidiary switch being connected to said n-th output means and said additional output means at said first and said second subsidiary connecting input terminals, respectively and being connected to said n-th gradation output terminal at said subsidiary connecting output terminal.

5. A driving device as claimed in claim 4, wherein said n-th primary switch comprises:

a first trimming portion for disconnecting said primary input terminal from said first primary connecting output terminal when an energy beam is irradiated to said first trimming portion; and a second trimming portion for connecting said primary connecting input terminal to said second primary connecting output terminal when said energy beam is irradiated to said second trimming portion;

said n-th subsidiary switch comprising:

a third trimming portion for disconnecting said first subsidiary connecting input terminal from said subsidiary output terminal when said energy beam is irradiated to said third trimming portion; and a fourth trimming portion for connecting said second subsidiary connecting input terminal to said subsidiary connecting output terminal when said energy beam is irradiated to said fourth trimming portion.

6. A driving device as claimed in claim 1, said first through said N-th output means belonging to either one of first through M-th groups, where M is a positive integer which is less than said positive integer N, wherein said additional output means is located in each of said first through said M-th groups.

7. A driving device as claimed in claim 1, wherein said n-th output means comprises:

a data register for registering said display data signal as a registered signal in said n-th control signal;

a latch circuit for latching said registered signal as a latched signal in accordance with a latch signal;

a D/A converter for converting said latched signal into an n-th voltage signal; and an amplifier circuit for amplifying said n-th voltage signal into said n-th gradation voltage.

8. A driving device as claimed in claim 7, wherein said additional output means comprises:

an additional data register for registering said display data signal as an additional registered signal in said n-th control signal;

an additional latch circuit for latching said additional registered signal as an additional latched signal in accordance with said latch signal;

an additional D/A converter for converting said additional latched signal into an additional voltage signal; and an additional amplifier circuit for amplifying said additional voltage signal into said additional gradation voltage.

* * * * *